US008006669B2

(12) United States Patent
Unruh et al.

(10) Patent No.: US 8,006,669 B2
(45) Date of Patent: Aug. 30, 2011

(54) SEALING ARRANGEMENT OF A PIEZOACTUATOR FOR A FUEL INJECTION VALVE OF AN INTERNAL COMBUSTION ENGINE

(75) Inventors: Marcus Unruh, Zeitlarn (DE); Claus Zumstrull, Regenstauf (DE)

(73) Assignee: Continental Automotive GmbH, Hannover (DE)

( * ) Notice: Subject to any disclaimer, the term of this patent is extended or adjusted under 35 U.S.C. 154(b) by 23 days.

(21) Appl. No.: 12/306,408

(22) PCT Filed: Jun. 28, 2007

(86) PCT No.: PCT/EP2007/056459

§ 371 (c)(1),
(2), (4) Date: Feb. 23, 2009

(87) PCT Pub. No.: WO2008/000786

PCT Pub. Date: Jan. 3, 2008

(65) Prior Publication Data

US 2009/0283072 A1 Nov. 19, 2009

(30) Foreign Application Priority Data

Jun. 29, 2006 (DE) ..... 10 2006 029 966

(51) Int. Cl.
*F02M 51/00* (2006.01)

(52) U.S. Cl. ..... 123/470; 123/490; 239/102.2; 310/344

(58) Field of Classification Search ..... 123/470, 123/490; 239/102.1, 102.2, 88, 533.2; 310/344; 251/129.01, 129.15
See application file for complete search history.

(56) References Cited

U.S. PATENT DOCUMENTS

| | | | | |
|---|---|---|---|---|
| 2,823,251 | A * | 2/1958 | Clark | 174/153 R |
| 6,126,094 | A * | 10/2000 | Ricco | 239/585.1 |
| 6,899,570 | B2 * | 5/2005 | Afanasiev et al. | 439/737 |
| 6,974,088 | B2 | 12/2005 | Albert et al. | 239/88 |
| 7,097,484 | B2 | 8/2006 | Schuerz et al. | |
| 7,175,105 | B2 | 2/2007 | Plecher et al. | 239/102.2 |
| 7,275,958 | B2 * | 10/2007 | Unruh | 439/587 |

(Continued)

FOREIGN PATENT DOCUMENTS

DE 198 44 743 C1 6/2000

(Continued)

OTHER PUBLICATIONS

Written Opinion of the International Searching Authority (Supplementary Sheet) PCT/EP2007/056459, 1 page.

*Primary Examiner* — Hai H Huynh
(74) *Attorney, Agent, or Firm* — King & Spalding L.L.P.

(57) ABSTRACT

A sealing arrangement of a piezoactuator (12) for a fuel injection valve of an internal combustion engine, has connecting pins (14) projecting out of the piezoactuator (12) and a head arrangement (16, 18) placed on to the piezoactuator (12), which is provided with openings (20) for the penetration of the connecting pins (14), wherein a liquid-tight sealing element (30) abuts against the outer surfaces of the connecting pins (14) on one side and also against the head arrangement (16, 18) on the other. In order to ensure a reliable seal with this arrangement, in particular also over extended periods of time, the sealing element (30) abuts against the outer surfaces of the connecting pins (14) located inside the openings (20), and sealing element sections (32) located inside the openings (20) are radially compressed in the openings.

20 Claims, 2 Drawing Sheets

U.S. PATENT DOCUMENTS

| | | | | |
|---|---|---|---|---|
| 7,394,184 | B2 | 7/2008 | Plecher et al. | 310/340 |
| 7,793,863 | B2 * | 9/2010 | Unruh | 239/102.2 |
| 2004/0108481 | A1 | 6/2004 | Albert et al. | |
| 2005/0006495 | A1 | 1/2005 | Schuerz et al. | |
| 2006/0038030 | A1 | 2/2006 | Plecher et al. | |
| 2006/0038031 | A1 * | 2/2006 | Unruh | 239/102.2 |
| 2006/0038032 | A1 | 2/2006 | Plecher et al. | |

FOREIGN PATENT DOCUMENTS

| | | | |
|---|---|---|---|
| DE | 19844743 | C1 | 6/2000 |
| DE | 199 56 256 | B4 | 6/2001 |
| DE | 100 07 175 | A1 | 8/2001 |
| DE | 10007175 | A1 | 8/2001 |
| DE | 19956256 | B4 | 4/2004 |
| DE | 10205909 | B4 | 11/2005 |
| DE | 10 2004 042 353 | A1 | 3/2006 |
| DE | 102004042353 | A1 | 3/2006 |
| EP | 1 420 467 | A2 | 10/2003 |
| EP | 1420467 | A2 | 5/2004 |
| EP | 1 628 016 | A | 9/2004 |
| EP | 1 628 015 | A1 | 2/2006 |
| EP | 1628015 | A1 | 2/2006 |
| EP | 1628016 | A1 | 2/2006 |

* cited by examiner

SEALING ARRANGEMENT OF A PIEZOACTUATOR FOR A FUEL INJECTION VALVE OF AN INTERNAL COMBUSTION ENGINE

CROSS-REFERENCE TO RELATED APPLICATIONS

This application is a U.S. National Stage Application of International Application No. PCT/EP2007/056459 filed Jun. 28, 2007, which designates the United States of America, and claims priority to German Application No. 10 2006 029 966.3 filed Jun. 29, 2006, the contents of which are hereby incorporated by reference in their entirety.

TECHNICAL FIELD

The present invention relates to a sealing arrangement.

BACKGROUND

Such an arrangement is for example known from DE 10 2004 042 353 A1. In the known sealing arrangement a seal is realized by means of an elastomer sealing disk, from which dome-shaped sealing element sections extending out from the plane of the disk abut to form a seal against the outer surfaces of connecting pin sections which project from the openings of the top plate placed on the piezoactuator. Preferably the contact force for providing the sealing effect here is supplied by an elastic pretensioning of the material of the elastomer sealing disk.

A disadvantage of the known sealing arrangement is that the contact force and thereby the sealing effect is limited by the material properties of the sealing element. In addition there is the danger of this contact force diminishing over time because of a relaxation of the material. Finally a disadvantage which might arise under some circumstances is that the sealing arrangement demands space on the side of the top plate arrangement opposite the piezoactuator.

SUMMARY

According to various embodiments, a sealing arrangement of the type mentioned at the start can be developed so that a reliable seal, especially for longer periods too, can be ensured.

According to an embodiment, a sealing arrangement of a piezoactuator for a fuel injection valve of an internal combustion engine, comprising: connecting pins projecting from the piezoactuator and a head arrangement placed onto the piezoactuator, which is provided with openings for the connecting pins to pass through it, with a sealing element formed from a material forming a seal against liquid being placed on it, which the one hand seals against the outer surfaces of the connecting pins and on the other hand seals against the head arrangement, wherein the sealing contact between the sealing element and the outer surfaces of the connecting pins is provided within the openings and sealing element sections within the openings are compressed radially in the openings.

According to a further embodiment, the sealing element sections may be embodied as sealing beads. According to a further embodiment, the sealing beads may have at least approximately the shape of an O-ring. According to a further embodiment, the sealing beads each may form an end of a dome-shaped sealing element section protruding into the opening. According to a further embodiment, the sealing element may be embodied from an elastomer. According to a further embodiment, the sealing element may be embodied from a material with high gas permeability. According to a further embodiment, the sealing element may be embodied from a silicon material, especially a fluorsilicon material. According to a further embodiment, the sealing element may be embodied in the form of a disk and the face side of the sealing element facing the head arrangement essentially following the contour of the head arrangement. According to a further embodiment, the head arrangement may comprise a head plate, in which the openings of the head arrangement are provided to allow the connecting pins to pass through. According to a further embodiment, the sealing element may be in firm contact all around the circumference of the head arrangement to form a seal. According to a further embodiment, a sleeve-type actuator housing together with a head plate as well as with a base plate may be are arranged at both ends of the actuator housing delimiting an actuator space, in which the piezoactuator is accommodated. According to a further embodiment, the sealing element may abut firmly on the axial end of the sleeve-type actuator housing. According to a further embodiment, a contact module may be placed on the head arrangement for further electrical connection of the connecting pins to a connector, with the contact module pressing the sealing element at least in sections against the head arrangement. According to a further embodiment, a contact module may be placed on the head arrangement for further electrical connection of the connecting pins to a connector, with the contact module pressing the sealing element sections against an exit from the openings. According to a further embodiment, the contact module may engage with an outer area of the head arrangement and being held on this outer area by a non-positive fit, especially a latch connection. According to a further embodiment, an insulating disk may be provided with openings through which the connecting pins can pass made of electrically insulating material being arranged between the sealing element and the head arrangement. According to a further embodiment, at least one ventilation passage may passing through the head arrangement may be provided.

According to another embodiment, a fuel injector for an internal combustion engine may comprise an injector housing arrangement, in which a piezoactuator for actuating a fuel injection valve with a sealing arrangement as described above may be accommodated.

According to a further embodiment, a ventilation arrangement may promotes an exchange of gas between the outer side of the injector housing arrangement and the outer side of the sealing element.

According to another embodiment, a method for using of a fuel injector as described above in a fuel injection system, may comprise the step of accommodating the fuel injector essentially completely within an engine block assembly of an internal combustion engine.

BRIEF DESCRIPTION OF THE DRAWINGS

The invention is explained in more detail below on the basis of an exemplary embodiment with reference to the enclosed drawings. The Figures show.

DETAILED DESCRIPTION

Figure 1:
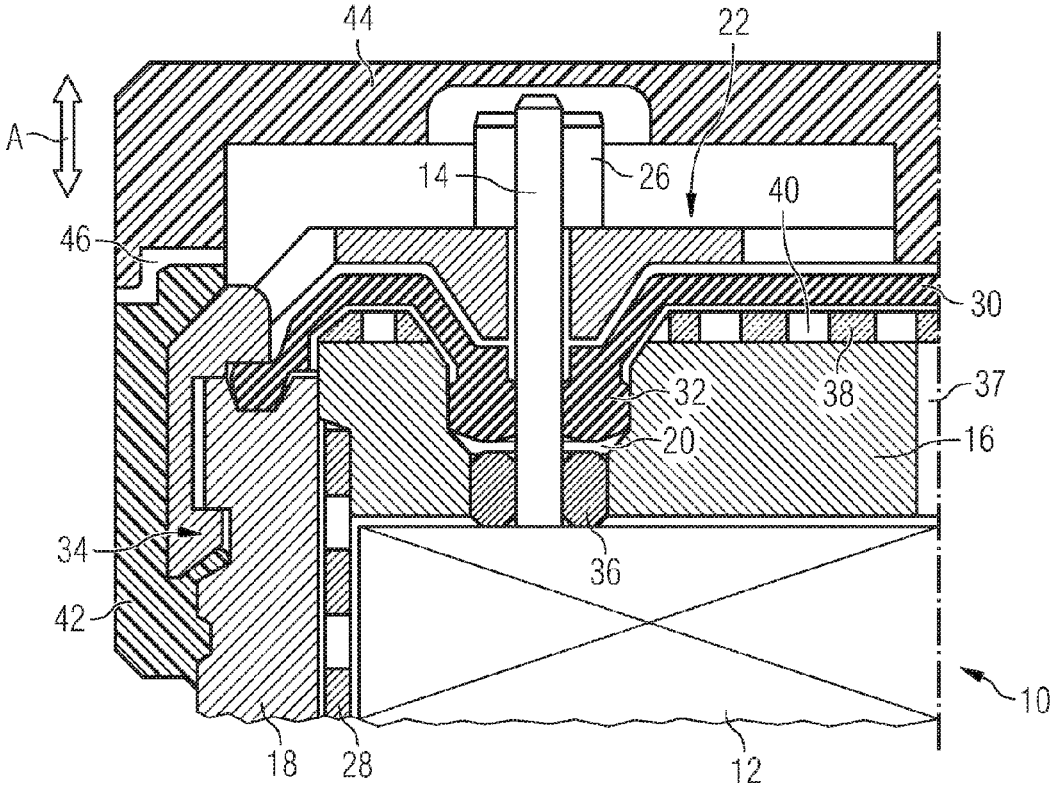
FIG. 1 is a detailed diagram from an axial longitudinal cross section of a piezo drive for a fuel injection valve.

With the sealing arrangement according to various embodiments there is provision for the sealing contact between the sealing element and the outer surfaces of the terminal pins to be provided within the openings and for sealing element sections within the openings to be radially compressed in the openings.

The sealing contact of the sealing element both on the outer surfaces of the connecting pins and also on the head arrangement makes reliable sealing possible. The first contact or sealing is also referred to below as "radial sealing" and the second contact or sealing is also referred to as "axial sealing".

In accordance with various embodiments radial sealing, because the sealing element sections are compressed radially between the connecting pins of the piezoactuator and the openings, is especially reliable and can also be maintained over long periods of time.

In an embodiment the sealing element sections are embodied as sealing beads. This measure enables the contact force used for radial sealing to be provided in a spatially well-defined manner. In addition this tends to improve the long-term stability of the sealing even further.

Numerous options emerge for designing the shape of the sealing beads. In one embodiment for example there is provision for the sealing beads to have at least approximately the shape of O-rings. Variations from this shape with other shapes or bead cross section are however possible. Especially if the connecting pins in the area of the radial seal as well as the adjacent inner surfaces of the openings in each case possess a cylindrical shape, a rotation-symmetrical sealing bead (e.g. O-ring type) is preferred for achieving an even contact force (both on the connecting pins and also on the inner surface of the opening). The sealing beads can for example each form one end of a sealing element dome protruding into the opening. The area of the opening, into which such a sealing element section (dome) projects, can for example have a cross-section which, starting from the opening edge, tapers in the direction into the head arrangements, e.g. through conical and/or stepped inner surface areas of the opening.

The sealing element can be embodied from an elastomer for example in respect of an optimum seal on the connecting pins (radial sealing) as well as on the head arrangement (axial sealing). For example the sealing element can be embodied from polyurethane, an elastomer of the type "FKM" such as. Viton (brand name) for example or an elastomer of the type "NBR" etc.

In an embodiment the sealing element material provides especially good electrical insulation. By selecting such a sealing element material no special precautions need be taken against an inadequate electrical insulation of the connecting pins in the case in which the head arrangement is electrically-conductive. The latter is generally the case, since the piezo housing arrangement overall and thus also the head arrangement are usually made of metallic materials. In the event of the material of the sealing element not providing sufficient insulation with an electrically-conductive head arrangement, there can be provision, at least in the area of contact of the sealing element on the head arrangement, for the sealing element material and/or the head arrangement to be electrically insulated, e.g. with an insulation layer or an insulating part.

A use of the sealing arrangement according to various embodiments is produced for the piezoactuator of a fuel injector of an internal combustion engine in which the fuel injector and at least one further component of a fuel injection device is essentially entirely arranged within an engine block assembly of the internal combustion engine. This means in particular the case in which there are components of the injection device accommodated within the engine block assembly which, without restricting their function, could also be accommodated outside the latter. The term "engine block assembly" in this case refers to the totality of components containing engine lubricating oil, that is the "engine block" in the narrower sense and parts mounted on it (such as a cylinder head cover etc.), into which the lubricating oil is pumped or lubricates or is fed (back). With this type of engine construction there is an increased danger of damaging media such as oil and/or fuel entering the inside of the injector housing or an actuator space. This is a particular problem for example with common-rail diesel engines with injection components lying within the cylinder head cover.

As is explained in DE 10 2004 042 353 A1 mentioned at the outset, it has turned out that the arrangement of a piezoceramic component such as the piezoactuator involved here in a "gastight as possible" piezo housing arrangement in an installation environment featuring damaging media does not prolong the life of the component in practice but instead tends to shorten it. As a result a significant prolonging of the durability or lifetime of the piezoactuator can be achieved through a certain "gas transparency" in the area of the sealing arrangement.

In an embodiment there is thus provision for embodying the sealing element from a material with a high gas permeability.

In particular a silicon material, especially fluorsilicon material can be selected as the material (e.g. elastomer of the type "LSR" or "FVMQ"). The latter materials, with a comparatively large thickness of the sealing elements also make possible a high permeation rate in relation to gaseous materials such as air for example. This characteristic is advantageous for the durability or lifetime of the piezoelectric ceramic of the piezoactuator.

For the above-mentioned engine construction in particular with an injection system essentially completely accommodated within an engine block assembly it has proved advantageous in respect of the durability or lifetime of the piezoactuator for cavities to be present within the enclosed actuator space. With the sealing arrangement according to various embodiments such cavities can be simply provided or enlarged within the sealed-off actuator space. In the sealing arrangement according to various embodiments significant proportions of the volume adjoined by the openings of the head arrangement can advantageously create additional cavities for example.

A compact embodiment of the sealing elements is produced for example if the sealing element is essentially embodied in the form of a disk overall, with sealing element sections being provided however for obtaining the radial sealing, which extend from the plane of the disk in an axial direction into the openings (and surround the connection pins).

In an especially compact embodiment there is provision for the front side of the sealing element to essentially follow the contour of the head arrangement. Preferably the sealing element (e.g. embodied in one piece in the form of a disk) lies at least in the form of a ring on the circumference of the head arrangement making a close seal around it (axial seal).

In a known way the head arrangement can comprise a head plate in which the openings of the head arrangement are provided to allow the connecting pins to pass through.

In an embodiment the piezoactuator is accommodated in an actuator space which is formed from a sleeve-shaped actuator housing as well as a head plate and a base plate arranged on either end of this actuator housing. The head plate can in this case be placed on one axial end of the actuator housing and welded to it, whereas in this case the base plate is introduced into the actuator housing so that it can be moved axially. Within such an actuator space the piezoactuator can be held under axial pressure pre-tension in an axial coil spring extended lengthwise which is welded at either end to the head plate and the base plate. The base plate can be embodied as part of an effective connection acting towards an activation element of a fuel injection valve. In this area the sealing of the actuator space can be made in a way which is known per se through a membrane welded between the inner wall of the actuator housing and the base plate.

To ensure reliable axial sealing the sealing element can for example, at least in an annular area surrounding the connecting pins, be pressed axially into the head arrangement, e.g. against the axial end of the actuator housing mentioned above.

Such an impression into the area of the axial seal can for example be provided by exerting axial pressure from a contact module arranged at one end of the injector housing for electrical connection of the injector. In one embodiment there is provision for such a contact module to press such the sealing element at least in sections against the head arrangement. These sealing element sections clamped to a certain extent between the contact module and the head arrangements can then bring about the axial sealing. The sealing element is pressed against the head arrangement in an especially well-defined manner if the contact module is provided for this purpose with one or more projection facing towards the sealing element which lead to the desired compression during the assembly of the fuel injector.

In another embodiment there is provision for the desired contact module to rest essentially with its full surface against the sealing element and thus exert especially even axial pressure on the sealing element. An axial pressure especially also in the area of the sealing material sections provided for radial sealing can in this case advantageously improve this radial sealing.

In one embodiment there is provision for a contact module for further electrical connection of the connecting pins to a plug-in connector to be placed on the head arrangement and for this contact module to secure the sealing sections against any escape from the openings.

A simple assembly of the contact module, in which the compression of the sealing element explained above can be guaranteed, is produced if the contact module engages with an area around the outer area of the head arrangement and is held on this outer area by a non-positive fit. This non-positive connection can especially be provided as a latching connection such that the pressure from the contact module causes it to latch with the head arrangement. The latching connection can for example be provided as a ring running around the circumference or also by a plurality of separate latching areas distributed around the circumference. An especially durable and close axial seal is produced if the latching connection is fixed afterwards into a final plastic encapsulation. The shrinking of the plastic material increases the compression force and thereby the clamping force of the sealing element.

There is provision in an embodiment for an insulating disk provided with openings to allow the contact pins to pass through and made of electrically-insulating material to be arranged between the sealing element and the head arrangement.

The advantageous actuator space volume can already be enlarged through the presence of such an insulation disk by a more-or-less large gap being provided between such an insulation disk and the adjoining components, such as for example head plate and sealing element. Such gaps are often produced compulsorily in practice.

The insulating disk can further feature cut-outs creating cavities. Such cut-outs can also be suitably provided to promote the gas exchange between the axially opposite sides of the insulation disk. If cavities are additionally present above or below the insulation disc or will be provided, cut-outs going through the insulation disk provide a greater contiguous cavity space which is advantageous for the durability of the piezoactuator. To guarantee ventilation through the head arrangement this can for example be provided with at least one through-opening (e.g. cavity). The insulating disk can be manufactured especially cost-effectively from plastic as an injection-molded part for example. With such an insulation disk an increased freedom is produced in the selection of the materials for the sealing element, since the electrical current is forced to take a "detour" depending on the geometrical embodiment of the insulation disk.

FIG. 1 illustrates an exemplary embodiment of a sealing arrangement of a piezoactuator 12 in a piezo drive designated overall by the number 1.

Figure 2:
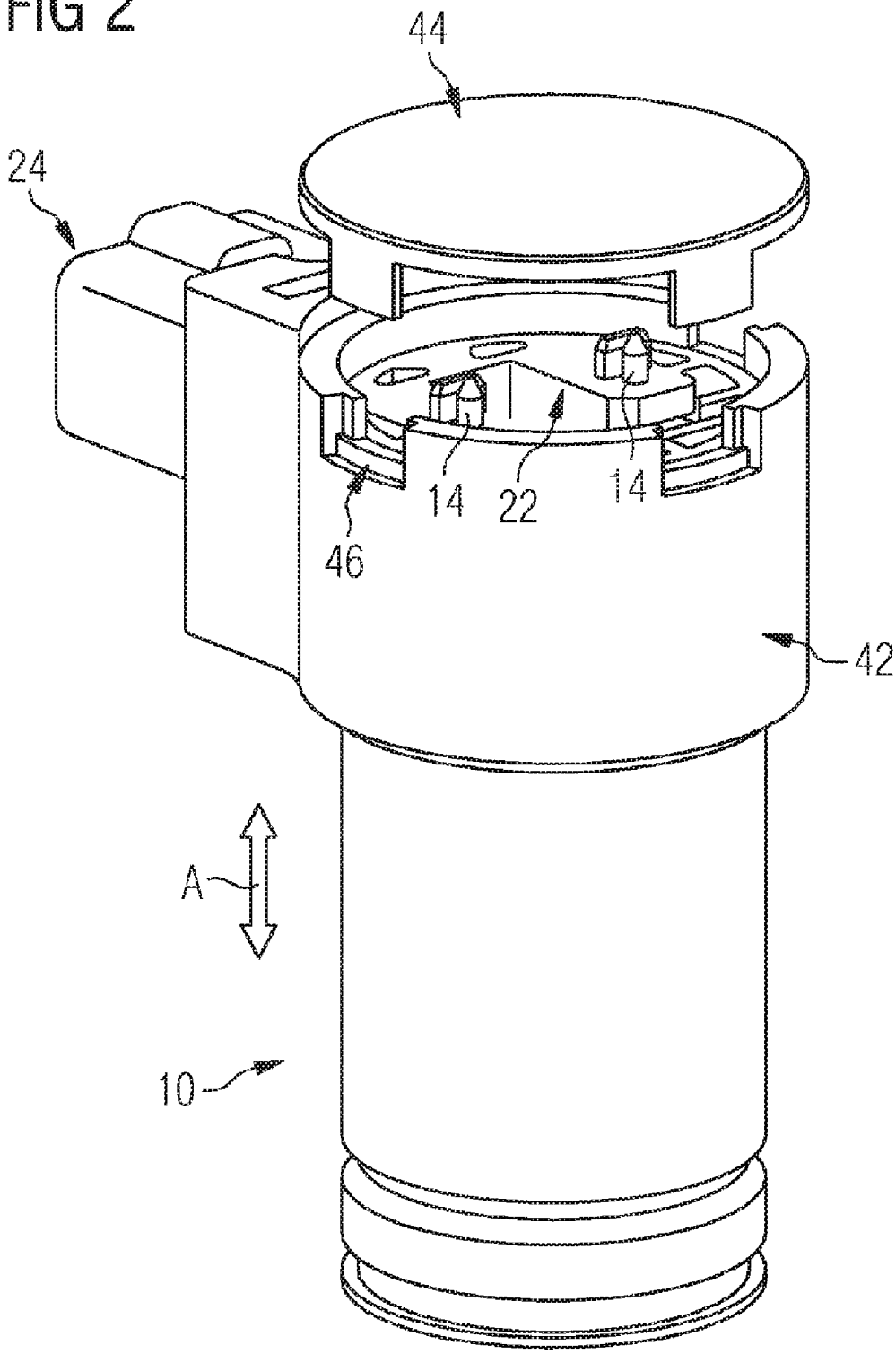
FIG. 2 is a perspective view of the piezo drive.

FIG. 2 shows the piezo drive 10 which is provided for actuation of the injection valve of a fuel injector of an internal combustion engine (e.g. diesel injector of a "common rail" injection system). In the installed state the piezo drive 10 shown together with an injection valve arranged in FIG. 1 below the piezo drive 10 but not shown in the figure, forms the fuel injector.

In respect of the basic structure of the fuel injector reference will merely be made to typical known constructions, as are described in DE 199 56 256 B4, DE 100 07 175 A1 and DE 2004 042 353 A1.

Returning to FIG. 1, in which, for the sake of simplifying the diagram, only a (left) half of the axial section (axial direction A) is shown, one of two connecting pins 14 can be seen protruding from the piezoactuator 12 and a head arrangement placed on the piezoactuator, which in the shown exemplary embodiment consists of a metallic head plate 16 and a sleeve-like actuator housing 18 and is provided with openings 20 for the connecting pins 14 to pass through.

In a known manner the piezo drive 10 comprises the piezoactuator 12 essentially formed from a piezo element stack, elongated in axial direction A, of which the axial extent can be changed in a controlled manner after application of a control voltage via the metallic connecting pins 14.

For electrical connection of the fuel injector said drive is provided at its upper end area in FIG. 1 with a contact module 22 embodied as a plastic molded part, from which formed contact tongues protrude sideways and form the electrical contacts of a plug connector 24 (FIG. 2) for further electrical connection. The contact module 22 is constructed as a so called contact tongue carrier, for the basic structure of which the reader is referred to DE 198 44 743 C1 for example.

The connecting pins 14 of the piezoactuator 12 pass upwards through the openings 20 of the head plate 16 embodied in the form of axial holes, so that connecting pin sections project axially out of the openings 20. The upper ends of the connecting pins 14 in FIG. 1 are welded to metallic tags 26 which in their turn are connected in one piece to the contact tongues of the contact module 22.

A tubular spring 28 is arranged in the sleeve-shaped actuator housing 18 in which the piezoactuator 12 is held under axial compressed pretension. For this purpose the tubular spring 28 is welded at its lower end (not shown) to a base plate guided to allow axial movement in the actuator housing 18, whereas the opposite, upper end of the tubular spring is welded 28 onto the circumference of the head plate 16.

The sealing of the actuator space located below the head plate 16 against the area of the contact module 22, or equivalently the sealing of the upper end of the sleeve-shaped actuator housing 18 is effected by the sealing arrangement described in greater detail below.

A sealing disk 30 formed from an elastomer sealing against liquid is placed on the head arrangement 16, 18, which on the one hand ("radial sealing") rests firmly against the head arrangement formed from the outer surfaces of the connecting pins 14 and on the other hand ("axial sealing") firmly against the head arrangement formed from the head plate 16 and the upper end of the sleeve-shaped actuator housing 18.

In the exemplary embodiment shown the axial sealing is provided as a ring running around the upper end of the actuator housing 18. The actuator housing 18 has an annular groove in this area, into which an outer edge of the sealing disk 30 engages to form a seal.

The radial sealing provided between the sealing disk 30 and the connecting pins 14 is likewise implemented by the elastomer sealing disk 30 which engages on the contact breakthroughs (openings 20) to provide a compression seal.

In the area where the connecting pins 14 pass through, the sealing disk 30 has sealing disk sections projecting axially in a dome shape into the openings 20, of which the lower ends in FIG. 1 are embodied as O-ring type sealing beads 32. The sealing contact between the sealing disk 30 on the outer surfaces of the connecting pins 14 is provided within the openings 20, with the sealing beads 32 located within the openings 20 being radially compressed in the openings 20. At this point the elastomer is thus not stretched, but is compressed between the connecting pins 14 and head plate hole.

The radial sealing in the area of the sealing beads 32 is thus based on a pressure load of the elastomer material predetermined by the geometry in this area. The sealing effect can thus be reliably guaranteed with comparatively high contact force and stable over longer periods.

A higher sealing force can be selected at the points of the radial seals as if only one elastic extent of a sealing material were used for creating a sealing force. A tensile relaxation of the elastomer no longer exerts any negative long term influence on the sealing effect. The characteristic variable decisive for the long-term sealing is in this embodiment the pressure deformation residue, which in accordance with investigations conducted tends to be more favorable for many advantageous materials to be used. Significantly improved sealing at the connecting pins is produced over the lifetime of the component.

The axial sealing is effected especially reliably in the exemplary embodiment shown by an axial compression of the sealing disk 30 down onto the head arrangement 16, 18. To this end the plastic material presses the contact module 22 with its underside down onto the outer circumference of the sealing ring 30, so that this is pressed all around against the face side of the actuator housing 18. At this point too, because of the elasticity of the sealing material used, a permanent sealing effect can be guaranteed.

The contact module 22 surrounds a receive zone of the actuator housing 18 and is held after it has been pressed on by a latching connection 34 provided in this area. In this case an all-around latching can be provided or distributed by individual latches over the circumference.

With the radial sealing in the embodiment shown a safeguard against the sealing beads 32 shaking out of the openings 20 is effected by a corresponding geometrical embodiment of the plastic body of the contact module 22 (above the elastomer sealing disk 30). To this end the sections of the plastic material of the contact module 22 extend axially to just above the sealing beads 32, which are thus secured against any escape from the openings 20. An installation of these sections of the contact modules 22 on the sealing beads 32 or even an axial pressing of these sealing beads 32 is possible, but is not provided in the exemplary embodiment shown.

An insulating sleeve 36 surrounding the connecting pins, which serves to electrically insulate the connecting pins 14 from the head plate 16, is inserted axially below the radial seal into the openings 20. Especially with a comparatively thin head plate such insulating sleeves can also be omitted.

The elastomer material of the sealing disk 30 is selected in respect of the best possible sealing against liquid, but also possesses a high gas permeability however. This allows a large permeation rate of "volatile materials" out of the actuator space and of oxygen into the actuator space to be achieved or promoted. To this end a ventilation hole 37 through the head plate 16 is provided in the exemplary embodiment shown.

In addition the sealing disk material also possesses the lowest possible electrical conductivity in order to insulate the connecting pins 14 from the head arrangement 16, 18 and thereby also from each other. An insulating disk 38 is inserted between the elastomer sealing disk 30 and the metallic head plate 16. This insulating disk 38 supplied with ventilation openings 40 advantageously effects an improvement of the gas throughput of the sealing arrangement.

In the installation of the piezo drive 10 the sealing disk 30 is placed onto the sections of the connecting pins 14 projecting from the openings 20, with the sealing beads 32 being pushed from above into the openings 20 and thereby compressed radially there. Pressing-on and latching the contact module 22 then causes the compression of the sealing disk 30 at the outer edge and the securing of the sealing beads 32. The connecting pin ends are then soldered to the solder tags 26 of the contact module 22. Finally a final encapsulation of the upper end of the piezo drive 10 is then undertaken. This encapsulation is provided as a sprayed on plastic coating 42 and a plastic cover 44 placed on it.

Breakthroughs in the plastic material of the contact module 22 ensure that a majority of the front side of the sealing disk 30 facing the contact module 22 is exposed to a space below the plastic cover 44, so that this front side of the sealing disk 30 can be ventilated especially efficiently. To promote an exchange of gas between the injector housing arrangement 42, 44 and the outer side of the sealing disk 30 at least one gas exchange opening 46 is provided in the outer plastic encapsulation 42, 44.

In the exemplary embodiment shown the plastic cover 44 is connected to the previously applied encapsulation 42 e.g. by a weld (e.g. laser welding). This two-part embodiment of the upper area of a housing arrangement has the advantage of the gas exchange opening 46 being able to be embodied in an especially simple manner as a gap left between these two encapsulation components.

Unlike in the exemplary embodiment shown, it is conceivable to provide a one-piece final plastic encapsulation, which is however perforated (e.g. has a hole drilled through it) afterwards to create at least one gas exchange opening.

What is claimed is:

1. A sealing arrangement of a piezoactuator for a fuel injection valve of an internal combustion engine, comprising:

connecting pins projecting from the piezoactuator and a head arrangement placed onto the piezoactuator, the head arrangement including first openings for each of the connecting pins to pass through, an insulating disk arranged on top of said head arrangement having second openings corresponding to said first openings, and a sealing element formed from a material forming a seal against liquid the sealing element including (a) a disk shaped portion located outside of the first openings and on top of said insulating disk and (b) sealing portions extending through the second openings in the insulating disk and into each of the openings in the head arrangement, wherein the sealing portion extending into each opening directly seals against both (a) a radially exterior outer surface of the respective connecting pin extending through that opening and (b) a radially interior surface in said first openings of the head arrangement.

2. The sealing arrangement as claimed in claim 1, wherein the sealing portions of the sealing element are embodied as sealing beads.

3. The sealing arrangement as claimed in claim 2, wherein the sealing beads having at least approximately the shape of an O-ring.

4. The sealing arrangement as claimed in claim 2, wherein the sealing beads each form an end of a dome-shaped sealing element section protruding into the respective opening.

5. The sealing arrangement as claimed in claim 1, wherein the sealing element is formed from an elastomer.

6. The sealing arrangement as claimed in claim 1, wherein the sealing element is formed from a material with high gas permeability.

7. The sealing arrangement as claimed in claim 6, wherein the sealing element is formed from a fluorsilicon material.

8. The sealing arrangement as claimed in claim 1, wherein the disk shaped portion of the sealing element essentially follows the contour of the head arrangement.

9. The sealing arrangement as claimed in claim 1, wherein the head arrangement comprises a head plate, in which the openings of the head arrangement are provided to allow the connecting pins to pass through.

10. The sealing arrangement as claimed in claim 1, wherein the sealing element is in firm contact all around the circumference of the head arrangement to form a seal.

11. The sealing arrangement as claimed in claim 1, wherein the head arrangement comprises a sleeve-type actuator housing together with a head plate.

12. The sealing arrangement as claimed in claim 11, wherein the sealing element abuts firmly on the axial end of the sleeve-type actuator housing.

13. The sealing arrangement as claimed in claim 1, wherein a contact module having portions each being received by said connecting pins, the contact module being placed on the head arrangement such that said contact module portions press against the sealing portions of the sealing element.

14. The sealing arrangement as claimed in claim 1, wherein each contact module portion is conical in shape and configured to surround a connecting pin.

15. The sealing arrangement as claimed in claim 1, wherein the contact module engages with an outer area of the head arrangement and is held on this outer area by a latch connection.

16. The sealing arrangement as claimed in claim 1, wherein the insulating disk is provided with further ventilation openings.

17. The sealing arrangement as claimed in claim 1, wherein at least one ventilation passage passing through the head arrangement is provided.

18. A fuel injector for an internal combustion engine, comprising an injector housing arrangement, in which a piezoactuator for actuating a fuel injection valve with a sealing arrangement is accommodated, wherein the sealing arrangement comprises:

connecting pins projecting from the piezoactuator and a head arrangement placed onto the piezoactuator, the head arrangement including openings for each of the connecting pins to pass through, and a sealing element formed from a material forming a seal against liquid, the sealing element including (a) disk shaped portion located on top of an insulating disk and (b) sealing portions extending through one or more openings in the insulating disk and into each of the openings in the head arrangement, wherein the sealing portions extending into each opening are in direct contact with the head arrangement and a respective connecting pin and seal against both (a) a radially exterior outer surface of the respective connecting pin extending through that opening and (b) a radially interior surface of said openings in the head arrangement.

19. The fuel injector as claimed in claim 18, further comprising a contact module having portions each being received by said connecting pins, the contact module being placed on the head arrangement wherein said contact module portions press against the sealing portions of the sealing element.

20. The fuel injector as claimed in claim 19, wherein each contact module portion is conical in shape and configured to surround a connecting pin.

* * * * *